US005109743A

United States Patent [19]

Gämmerler

[11] Patent Number: 5,109,743

[45] Date of Patent: May 5, 1992

[54] CUTTING KNIFE FOR ROTARY CUTTING APPARATUSES FOR PAPER

[76] Inventor: Gunter Gämmerler, Sudetenstrasse 31, D-8190 Wolfratshausen, Fed. Rep. of Germany

[21] Appl. No.: 777,464

[22] Filed: Oct. 17, 1991

Related U.S. Application Data

[63] Continuation of Ser. No. 510,954, Apr. 19, 1990, abandoned.

[30] Foreign Application Priority Data

Apr. 28, 1989 [DE] Fed. Rep. of Germany ..... 3914207

[51] Int. Cl.[5] ..... B26D 1/14

[52] U.S. Cl. ..... 83/676; 83/841; 83/844

[58] Field of Search ..... 83/836, 840, 841, 844, 83/854, 676; 407/42, 48, 51, 62, 64, 113

[56] References Cited

U.S. PATENT DOCUMENTS

| | | | |
|---|---|---|---|
| 1,549,036 | 8/1925 | Westgard | 83/841 |
| 2,472,876 | 6/1949 | Ahrndt et al. | 83/676 |
| 3,568,284 | 3/1971 | Lunden et al. | 407/51 |

FOREIGN PATENT DOCUMENTS

| | | | |
|---|---|---|---|
| 2950698 | 7/1980 | Fed. Rep. of Germany | 407/48 |
| 0665983 | 2/1952 | United Kingdom | 146/102 |

*Primary Examiner*—Frank T. Yost
*Assistant Examiner*—Allan M. Schrock
*Attorney, Agent, or Firm*—Palmatier & Sjoquist

[57] ABSTRACT

In a cutting knife for rotary cutting apparatuses for paper, in particular multilayer separated paper products, having a circular base body, from the conical face of which opposite the cutting plane adjustable blades or the like project, the blades are arrested adjustably about a fulcrum or pivot point.

6 Claims, 3 Drawing Sheets

CUTTING KNIFE FOR ROTARY CUTTING APPARATUSES FOR PAPER

This application is a continuation of U.S. application Ser. No. 510,954, filed Apr. 19, 1990, now abandoned.

The invention relates to a cutting knife for rotary apparatuses for paper, in particular multilayer separated paper products, comprising a circular base body from the conical rear face of which opposite the cutting plane adjustable blades or the like project.

DE-OS 3,719,721 discloses such a cutting knife. The individual blades are made board-like and displaceable substantially radially or at an acute angle to the respective radial. Regrinding of the individual blades is possible depending on the wear of each blade consisting of specially hardened steel, the radius of the cutting knife remaining unchanged after the grinding. This known cutting knife has largely proved itself in practice.

The invention is based on the problem of providing a cutting knife of the type mentioned at the beginning which is provided with blades arrested in different manner.

The problem is solved in that the blades or the like are arrested adjustably about a fulcrum. According to one embodiment of the invention the blades or the like are formed from discs with circular grinding and are adjustably held in cutouts in the base body.

According to a modified embodiment of the invention the blades or the like are made as plate-like polygons and have cutting faces on all sides; the blades or the like can be held adjustably either in circular cutouts or in polygonal cutouts in the base body.

In all embodiments the procedure is expediently to connect the blades or the like only in their fulcrum and in each case one further hole to the base body. On adjusting the blades, although both securing means are loosened only one securing means is detached and replaced at another point.

According to a modified embodiment of the invention the blades or the like are made board-like, adjustable in approximately wedge-shaped cutouts or recesses and connected in their hole-like fulcrum and in each case one further hole to the base body. For adjustable arresting of the board-like blades or the like the base body may be provided with respective partially circular cutouts or recesses. In order on the one hand to protect the cutting faces, in so far as they lie in the region of the base body, from damage and on the other to largely eliminate any possibility of injury to the operator of the cutting knife, the blades or the like are preferably covered on the conical rear face for example by a protective ring. Instead of a protective ring approximately horseshoe-shaped cover plates may be associated with the individual blades. However, it should be ensured that no cutting edge lying outside the actual cutting face lies free in any manner.

According to a preferred embodiment of the invention the protective ring therefore has at least the width of the blades or the like.

To improve the cutting action the respective cutting faces of the blades or the like may include an angle of 9°–12°, preferably 8°, with respective tangent of the base body. However, in this case the direction of rotation of the base body is fixed.

As in the known displaceable board-like blades as well said blades may consist of a material different from the base body and a specially hardened steel.

In the case of the former embodiment of a disc or also in the case of partial discs all the cutting faces of the blades or the like may be ground before insertion thereof. In these cases it is therefore substantially necessary after wear of a cutting face to loosen the securing means of the individual discs or partial discs or correspondingly remove said securing means, turn the disc or partial disc and arrest it again.

Embodiments of the invention are illustrated by way of example in the drawings; they will be described in detail hereinafter. In the drawings.

In all the embodiments described below the cutting knife consists of a base body 1 and blades 2 arrestable thereon. Such cutting knives are used in rotary cutting machines for example in paper products or signatures brought up in stream formation. These separating paper products are held together on both sides of the cutting knife by pressing belts.

Figure 1:
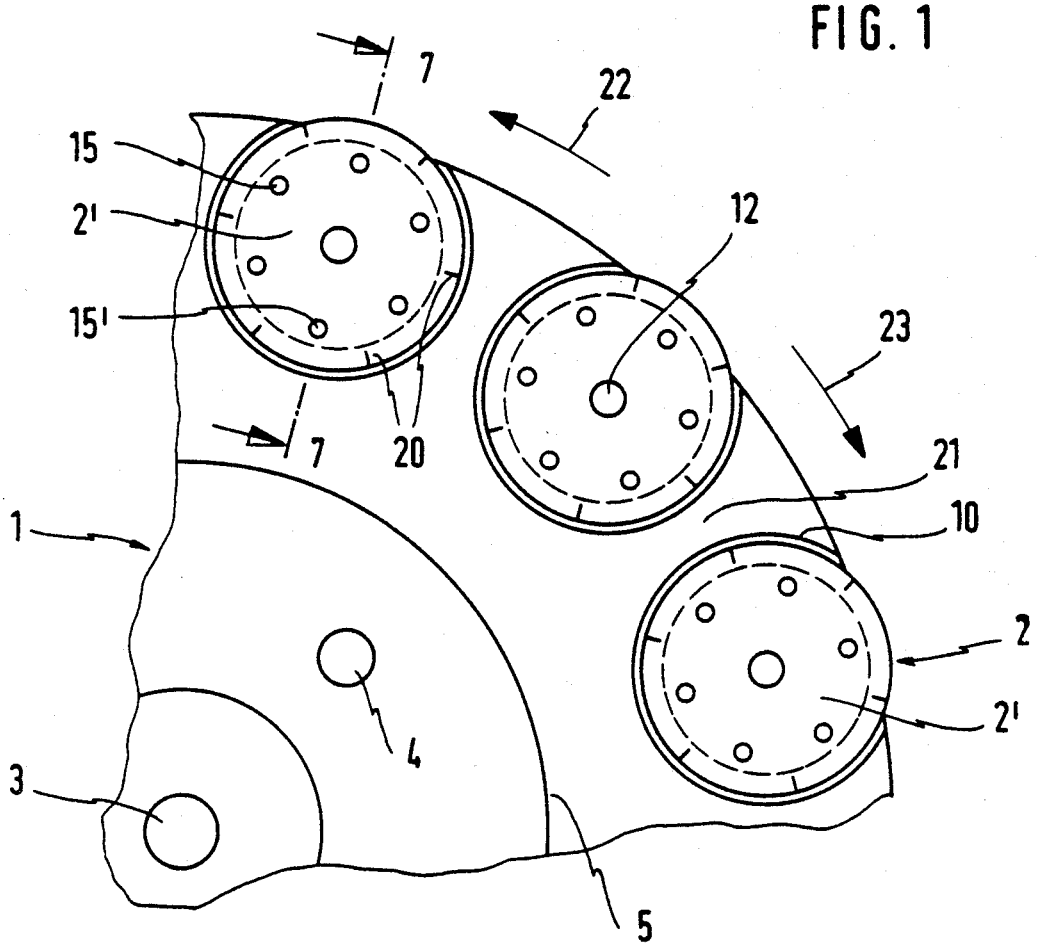
FIG. 1 is a partial view of the rear face of a cutting knife according to an embodiment of the invention.

As can be seen in FIG. 1 the base body 1 is provided with a central opening 3 for placing on a shaft. Furthermore, the base body comprises bores 4 for securing to a holder. Whereas the base body 1 is of uniform thickness in its central region its edges extend conically or approximately conically from the edge 5 onwards. Within the conically extending edge cutouts or recesses 10 are provided which in the present case are circular and have substantially the depth of the blades 2' formed as discs and each having a circular grind 11. The blades are made conical in cross-section and are connected on the one hand in their centre by a pin-like connection to the base body 1 and on the other hand to a protective body 14 described in detail.

As apparent from FIG. 1, each disc 2' comprises apart from the centre bore 12 six further holes 15 which are distributed uniformly along the periphery but spaced from the edge thereof. The particular radially inwardly disposed hole 15' receives a screw bolt or other connecting means and thus arrests the disc 2' in the respective position. The protective ring 14 is connected by a further screw 16 to the base body 1 and otherwise not illustrated in FIGS. 1 to 6.

On the rear side of the disc 2' markings 20 are provided which each define a cutting region. When a cutting region is worn the disc is turned into the next marked portion and arrested or locked in said position.

The disc 2', as also by the way in all further embodiments of the blades described below, are about 3–5 mm, preferably 4 mm, thick. The base body can have a diameter of 20–45 mm, and the number of blades or discs can be increased depending on the diameter of said body. It is by the way not necessary to provide a large distance 21 between the cutouts for the blades; on the contrary, this distance may also be practically zero.

As indicated by the arrows 22 and 23 the embodiment of the cutting knife according to claim 1 can be used in both directions of rotation. In the embodiment of a similar configuration of the base body 1 shown in FIG. 2 a hexagonal form of the blade 2'' is provided; the respective cutting edges 30 are of equal length, the rear side of the disc being formed conical in cross-section as indicated in dashed line so that the one side, which serves as cutting edge, assumes a position illustrated for example in FIG. 2. The cutout 31 for receiving the hexagonal disc 2'' is adapted in the present case to the cornered form of the disc so that on adjustment of the disc 2'' the latter must be raised out of the cutout and brought into a different cutting position.

As in the present case, in all other embodiments as well the cutting plane 32 is formed by the end side of the cutting knife or base body 1 and continues in the conical configuration of the respective blade flush up to the actual free cutting edge.

Figure 3:
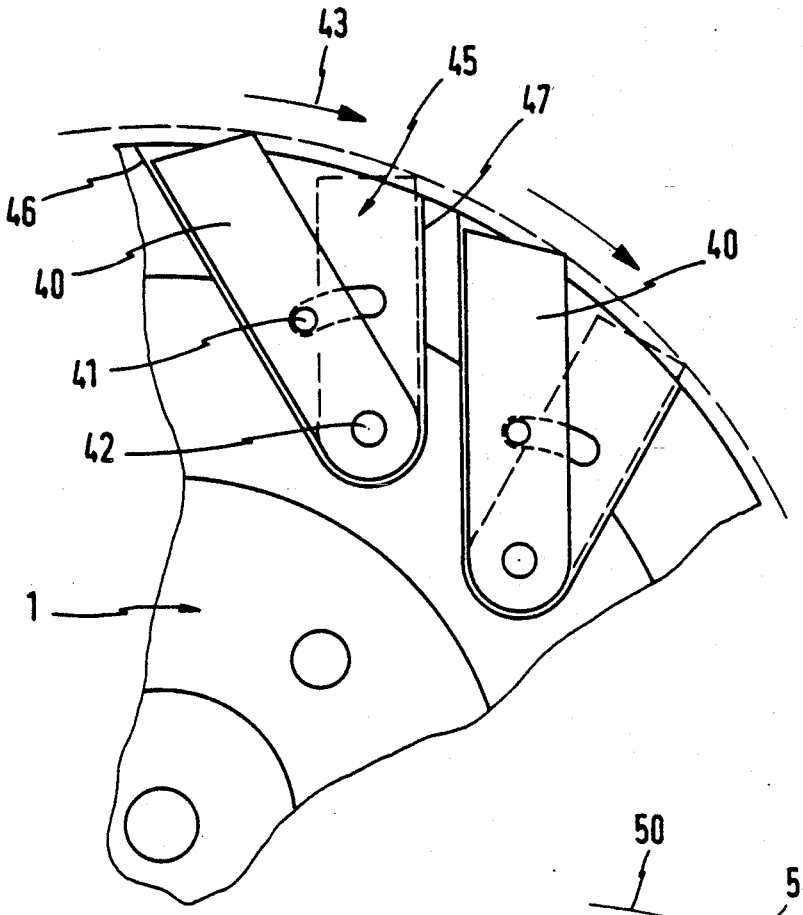
FIG. 3 is a partial view of a third embodiment of the invention in similar illustration.
Figure 4:
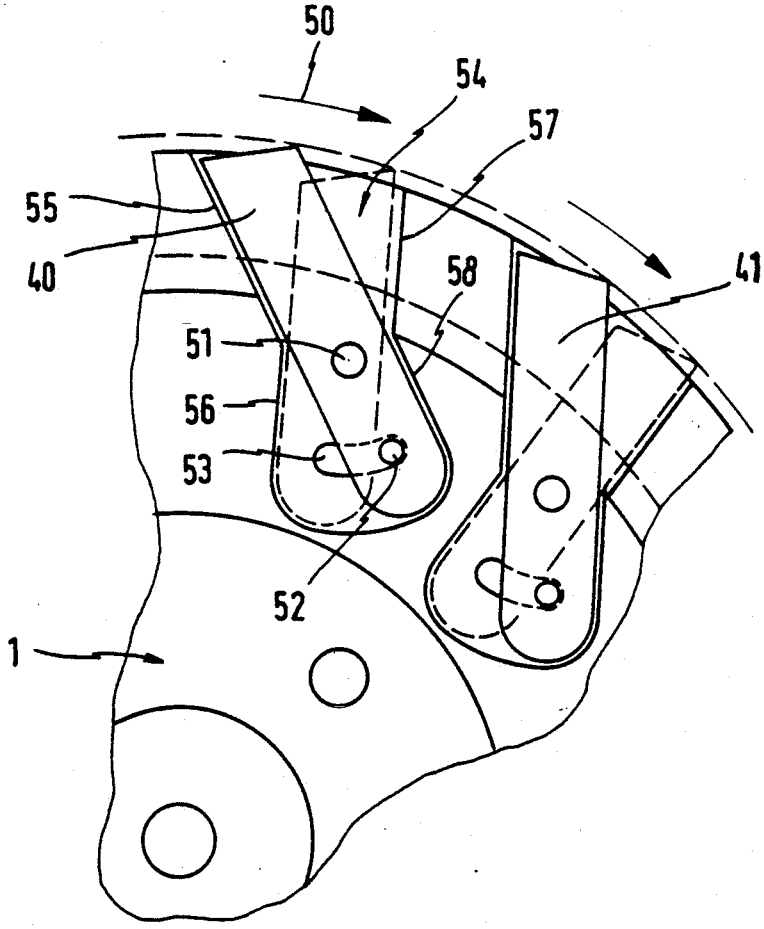
FIG. 4 is; a partial view of a fourth embodiment of the invention in similar illustration.
Figure 5:
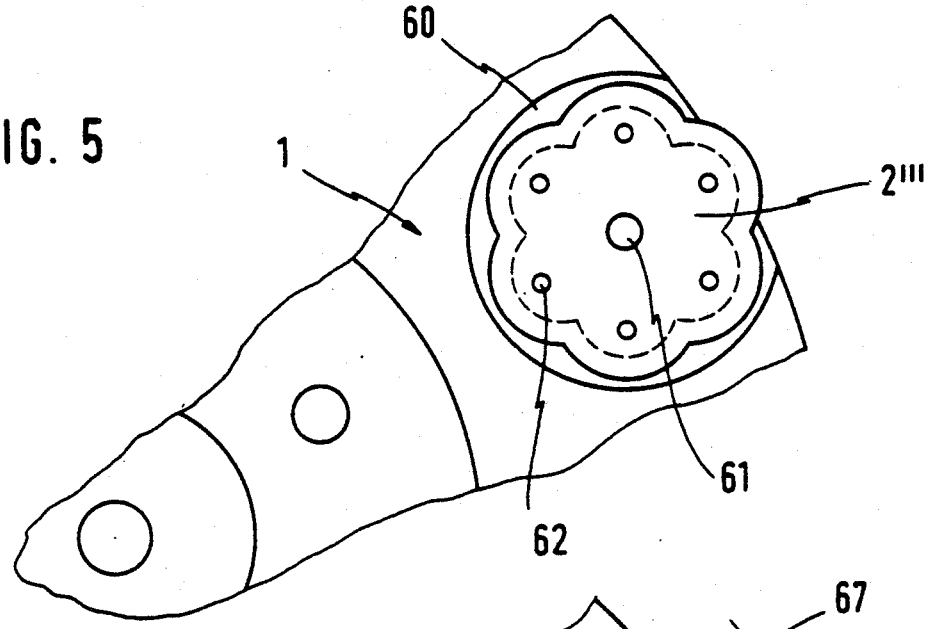
FIG. 5 is a partial view of a fifth embodiment of the invention in similar illustration.
Figure 6:
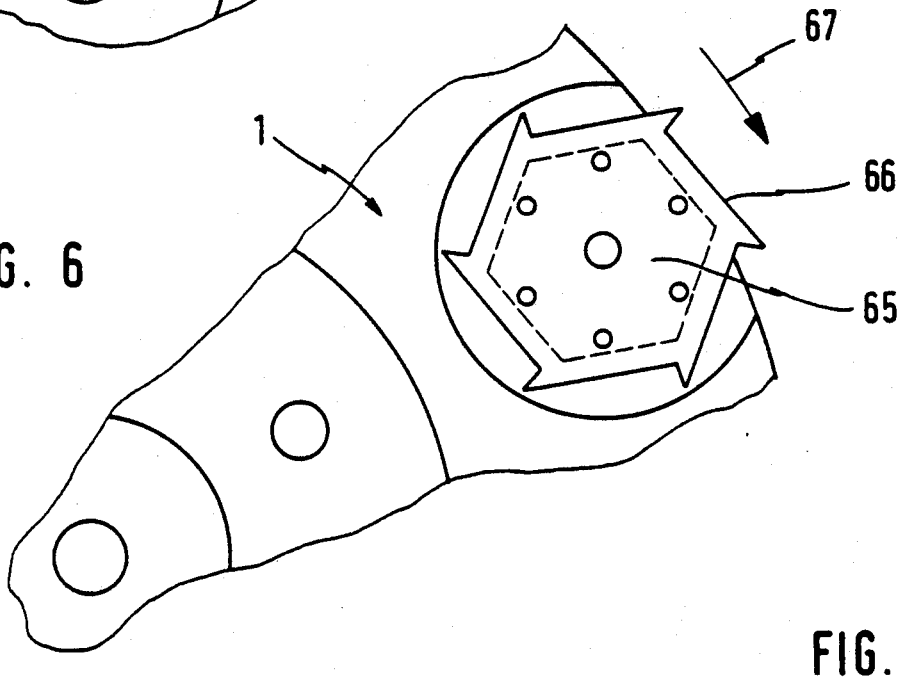
FIG. 6 is a partial view of a sixth embodiment of the invention in similar illustration and FIG. 7 is a section along the line 7—7 of FIG. 1.
Figure 7:
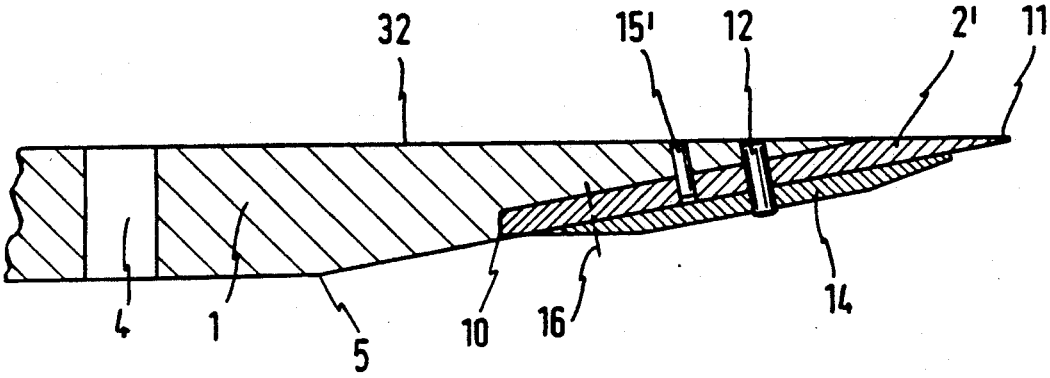

Whereas the embodiments according to FIGS. 1, 2 and the subsequently described embodiment according to FIGS. 5 and 6 are fundamentally used circularly ground, i.e. regrinding of said blades is eliminated, in the embodiments according to FIGS. 3 and 4 a board-like blade 40 or 41 is provided which has parallel side faces and is likewise 3–5 mm, preferably 4 mm, thick.

The blades 40 and 41 must be reground after the respective adjustment. In FIG. 3 the blade on the left is shown in the initial position; it is held via the pin 41 in a rounded slot and turns about the pivot pin 42 when an adjustment is made. An infinitely variable adjustment is possible in the direction of the arrow 43 of the respective blade 40 and is to be adapted to the grinding requirements.

The blade 40 is adjustable in a wedge-shaped cutout of which the respective edges 46 and 47 define the adjustment possibility of the blade 40.

In a similar embodiment according to FIG. 4 an adjustment of the blade about the pivot pin 51 is possible in the direction of the arrow 50, the second arresting of the blade 41 being possible via the hole 52 in the rounded slot 53 of the base body 1. The cutout 54 for adjustable receiving of the blade 41 is adapted to the adjustment possibility so that the free edge 55 of the cutout extends inclined, i.e. approximately wedge-shaped, and thus merges into a portion 56 which runs approximately radially. The oppositely disposed edges 57 and 58 of the cutout 54 are formed correspondingly.

The embodiment of the blade 2''' illustrated in FIG. 5 are similar to the embodiment of FIG. 1 but the individual cutting edge portions are rounded outwardly and thus respectively give a larger cutting face. In this case as well the disc 2''' is also circularly ground in each case so that an adjustment in the cutout 60 is possible six times, i.e. effectively six cutting edges are provided. The arresting of the disc 2''' is firstly at the fulcrum 61 and then respectively via the one radially inwardly disposed hole 62.

Figure 2:
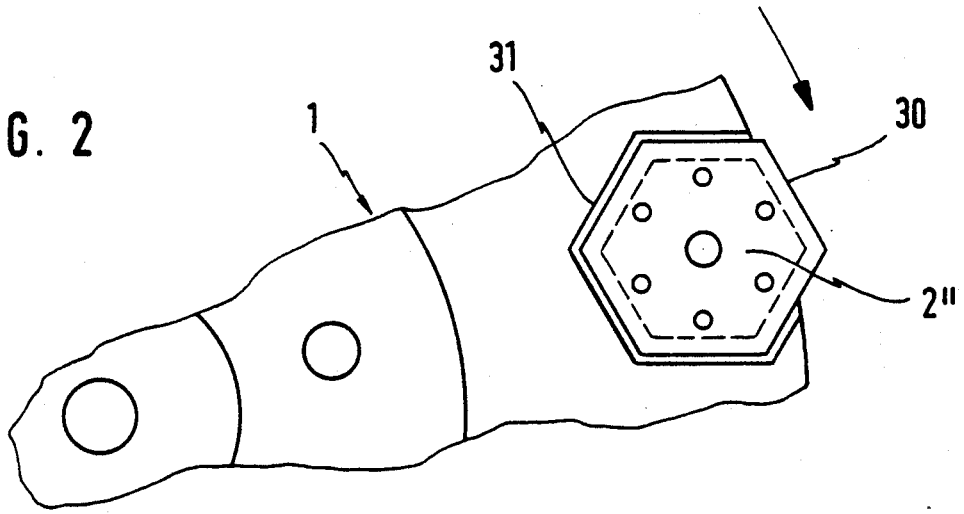
FIG. 2 is a partial view of a second embodiment of the invention in similar illustration.

Whereas the arresting of the notched disc 65 takes place in the same manner as described in conjunction with FIGS. 1, 2 and 5, the free edge of the disc 65 is provided with asymmetrically formed saw teeth 66; the cutting direction is indicated by the arrow 67. In the present case as well of course the cutting edge 66 lies in the plane 33 of the end side of the base body 1 and the disc 65 is in each case made conical in cross-section.

I claim:

1. A cutting knife for rotary cutting apparatuses for paper, in particular multilayer separated paper products, comprising a circular base body having a central region of uniform thickness with one surface of said central region forming a flat surface extending to a peripheral edge, and the other surface of said central region merging into a conically-tapered peripheral region terminating at said peripheral edge; a plurality of cutouts arranged about said conically-tapered peripheral region, said cutouts respectively opening into said peripheral edge; and a blade affixed in each of said cutouts, each blade having a sharpened further peripheral edge with a first blade surface in alignment with said base body flat surface; a portion of said further peripheral edge extending beyond said base body peripheral edge.

2. A cutting knife according to claim 1, further comprising means for removably affixing each said blade in a cutout whereby different portions of said sharpened further peripheral edge may be positioned beyond said base body peripheral edge.

3. Cutting knife according to claim 1, wherein said blades are each formed as discs with cylindrical grinding and are adjustably held in said cutouts in the base body.

4. Cutting knife according to claim 1, wherein said blades are each formed as plate-shaped polygonals and have sharpened peripheral edges on all sides.

5. Cutting knife according to claim 3, wherein said cutouts further comprise circular cutouts in the base body.

6. Cutting knife according to claim 4, wherein said cutouts further comprise polygonal cutouts in the base body.

* * * * *